US009574321B1

(12) United States Patent
Saulters

(10) Patent No.: US 9,574,321 B1
(45) Date of Patent: Feb. 21, 2017

(54) RAM THAT PUSHES SOIL FROM BENEATH BURIED PIPE

(71) Applicant: Danvil Danny Saulters, Collins, MS (US)

(72) Inventor: Danvil Danny Saulters, Collins, MS (US)

( * ) Notice: Subject to any disclaimer, the term of this patent is extended or adjusted under 35 U.S.C. 154(b) by 0 days.

(21) Appl. No.: 14/499,125

(22) Filed: Sep. 27, 2014

(51) Int. Cl.

| | |
|---|---|
| ***E02F 5/12*** | (2006.01) |
| ***E02F 3/96*** | (2006.01) |
| ***E02F 9/22*** | (2006.01) |
| ***E02F 5/00*** | (2006.01) |
| *E02F 3/32* | (2006.01) |

(52) U.S. Cl.
CPC ..... *E02F 3/964* (2013.01); *E02F 5/003* (2013.01); *E02F 9/22* (2013.01); *E02F 3/32* (2013.01)

(58) Field of Classification Search
CPC ..... E02F 5/033; E02F 5/022; E02F 5/12; E02F 5/14; E02F 5/18; E02F 3/962; E02F 3/967
USPC ... 172/250, 810; 37/347, 364, 366, 404, 903
See application file for complete search history.

(56) References Cited

U.S. PATENT DOCUMENTS 3,065,557 A * 11/1962 Pewthers ..... E02F 3/405 172/40
3,113,390 A * 12/1963 Pewthers ..... E02F 3/405 37/447
3,146,538 A 9/1964 Kiselev
3,257,744 A * 6/1966 Buhler ..... E01B 27/025 37/105
3,298,547 A * 1/1967 Williams ..... E02F 5/022 37/443
3,638,438 A * 2/1972 Kinnucan, Jr. ..... F16L 1/036 405/157
3,698,487 A * 10/1972 Ruth ..... E01H 1/00 172/305
3,792,539 A 2/1974 Clark
4,124,082 A * 11/1978 Garver ..... E21B 7/003 175/161
4,417,628 A * 11/1983 Gessner ..... E02F 3/962 173/159
4,691,455 A 9/1987 Newman
4,852,277 A 8/1989 Ward
5,240,352 A * 8/1993 Ilomaki ..... E21B 7/205 175/62
5,628,130 A 5/1997 Desrochers
5,701,693 A * 12/1997 Brocious ..... E01H 1/003 172/305
5,711,385 A * 1/1998 Brotherton ..... E21B 7/046 175/171
5,953,839 A * 9/1999 Meeks ..... E02F 3/40 172/247

(Continued)

*Primary Examiner* — Gary Hartmann
(74) *Attorney, Agent, or Firm* — Francis P. Lipinski, Esquire

(57) ABSTRACT

A device that excavates soil from beneath buried utility pipe. The excavated soil is pushed out using a piston shaft actuated ram's head. The piston shaft is attached to a power shovel's bucket. The piston shaft is hydraulically operated. Soil from the excavated area, when pushed out, falls into a previously dug opposite trench that is deeper than the bucket side trench where the shovel bucket is positioned for the pushing operation. Once the soil is pushed out from beneath buried pipe, the pipe is now accessible for inspections.

6 Claims, 3 Drawing Sheets

(56) References Cited

U.S. PATENT DOCUMENTS

| | | | | |
|---|---|---|---|---|
| 6,000,152 | A * | 12/1999 | Tate | E02F 3/815 37/403 |
| 6,058,631 | A | 5/2000 | Crawford | |
| 7,172,033 | B2 * | 2/2007 | Woodcock | E02F 3/962 172/253 |
| 7,562,717 | B2 | 7/2009 | Woodcock et al. | |
| 7,721,375 | B2 * | 5/2010 | Harr | B08B 9/043 15/104.31 |
| 7,725,978 | B2 * | 6/2010 | Harr | B08B 9/0436 15/104.05 |
| 7,963,053 | B1 * | 6/2011 | Courville | E02F 3/962 37/405 |
| 8,322,947 | B2 * | 12/2012 | Neumann | E01C 19/15 404/101 |
| 8,484,866 | B2 * | 7/2013 | Fluharty | E02F 3/082 37/352 |
| 8,869,911 | B2 * | 10/2014 | Anderson | E02F 3/3414 172/815 |
| 8,875,421 | B2 * | 11/2014 | Paull | E02F 9/265 172/233 |
| 2011/0247518 | A1 * | 10/2011 | Winkleman | E01B 27/025 104/7.3 |

* cited by examiner

RAM THAT PUSHES SOIL FROM BENEATH BURIED PIPE

BACKGROUND

Field of Invention

This present invention is directed to Class 37 Excavating and Class 172 Earth working. More particularly, this device progresses the art for excavation and trench safety. The invention uses a piston-actuated ram to push soil from the area beneath buried piping. This excavating device eliminates the need for laborers to enter a trench or confined space to prepare for routine pipe inspection.

What is new and unobvious in this present invention is a ram and piston attached to a power shovel's bucket to push soil from underneath buried utility piping for routine pipe inspection. Presently common in the art of excavating buried pipe, an area directly beneath the now-exposed pipe remains to be excavated by hand laborers once trenches on either side of the pipe are dug by the power shovel's bucket. Completing the excavation requires putting laborers into the trench to clean underneath of the buried pipe. The safety procedures proscribed by law are proscriptive to the point where a better way for removing the soil had to be invented. This invention overcomes that human safety concern and causes the entire buried pipe to be excavated and exposed by use of a ram having a head, a telescoping piston, and a hydraulic power source mounted in a bucket of power shovel.

The present invention is a device that pushes soil from beneath a buried pipe for inspection. A metal plate is attached to a telescoping piston shaft. Once the power shovel positions the bucket in the trench, hydraulic pressure telescopes the piston to push soil from underneath of a buried utility pipe. The excavated soil falls into an opposite trench. That opposite trench is previously dug to a depth deeper than the trench where the device is positioned. Using a heavy equipment operator's skill of depth perception, the trenches are level at the end of the excavation process.

When soil is pushed and removed from beneath the pipe, inspectors can now access the pipe surface for x-ray testing and other necessary informative testing.

The device is designed for trench work associated with the preparation of a site for inspection of the buried piping on a routine frequency. Safety of the laborers is a major concern on the job site. With laborers in the trenches, Occupational Safety Health Administration (OSHA) requirements for protecting workers from cave-in and falling soil increase the cost and time associated with excavating. The need to find a better way to remove soil without subjecting laborers to risky situations precipitated this invention.

The foundation for the device mounting and the point of reference for the patent application description begins at a bucket on an excavating power shovel that can support the weight of a hydraulic press, a multi-staged piston, a pinned coupling, and a head pushing device.

Hydraulic operation provides the motive force to move a multi-stage piston. The multi-stage piston expands to a range of less than the shovel bucket's face width. This bucket space is a function of the width of the bucket. The bucket accommodates a commercial-off-the-shelf hydraulic press of the builder's choice. The model of hydraulic press used to typify the invention in this field application is a four (4) foot, two-stage, hydraulically operated piston. Four (4) feet of ram travel range is sufficient to cover the distance under utility piping. If larger or smaller pipe is to be inspected, a hydraulically operated piston of a different travel range may be installed in the bucket.

Additionally, if greater pushing capacity is needed, an alternate head device can be attached using attachment brackets and a tongued coupling. Pushing capacity is used to measure the amount of soil pushed per stroke of a piston shaft.

To utilize the excavation device invention, a power shovel operator digs a trench on either side of a previously identified, underground pipe. One trench is dug slightly deeper than the other trench. This deeper fill side trench will receive the fill soil unearthed from beneath the pipe during an excavating project.

A ram that pushes soil from beneath buried pipe operation begins with the power shovel bucket positioned in the shallower, bucket side trench. Once the bucket is positioned in the bucket side trench, the operator aligns the ram having a head to a position. With the position alignment established, the operator applies hydraulic pressure and the telescoping piston shaft extends from the side wall of the bucket. When the piston and head telescope out away from the bucket, the devices will travel beneath the buried pipe. The head then contacts the soil and pushes the soil out from beneath the buried pipe. The excavated soil falls in to the fill side trench. This operation both cleans the area beneath the buried pipe and uses the residual fill soil to increase the level in the opposite trench so the trench is level for the next working crew; generally the pipe inspectors.

Throughout the nation, much utility infrastructure is buried underground. Routine inspections prevent 'down-time' for oil flow processes, electricity flow through cable traces, and water flow thru modern viaducts. Many of these buried pipes, which make up a valuable resource to the United States of America, must be inspected.

Prior Art

The art for this invention is Class 137 Excavating and Class 172 Earth working.

Notably, Desrochers, U.S. Pat. No. 5,628,130, in the BACKGROUND section, teaches an excellent overview of the art of excavating beneath buried utility line. The art is to excavate the mass of soil surrounding the buried pipe so that testing and inspection can be perform circumferentially. Desrochers uses a knife-like plate to excavate. The disadvantage is that some soil is left to be removed by laborers adhering to proscriptive and expensive safety rules.

Woodcock et al., U.S. Pat. No. 7,562,717 B2, issued Jul. 21, 2009, describes a tool which cleans culvert openings that is mounted to heavy machinery. This invention utilizes a telescoping ram. However, the Woodcock et al. invention works like a toothpick to clean culverts as compared to the Saulters ram purpose of pushing soil from beneath buried pipe.

Clark, U.S. Pat. No. 3,792,539, issued Feb. 19, 1974, excavates trenches leaving a sloped sidewall of the trench. This invention is common in that it uses attachments to the bucket. The attachments are different than the Saulters' attachments.

Crawford, U.S. Pat. No. 6,058,631, dated May 9, 2000 teaches a trench cleaning apparatus. However, this invention is for picking up "crumbs" from the trench floor.

Ward, U.S. Pat. No. 4,852,277, issued Aug. 1, 1989, is valuable to teach a tool built into a bucket. The hydraulic press of the Saulters invention is fitted inside the bucket.

Newman, U.S. Pat. No. 4,691,455, Sep. 8, 1987, "TRENCHING EQUIPMENT WITH HINGED SIDE PLATES" assists with classification identification, M. M. Kislev, U.S. Pat. No. 3,146,538, Feb. 11, 1964 teaches a multi-bucket trench excavator with adjustable chain side cutters for widening a ditch or for pushing loose dirt away from a ditch. This is similar to removing soil next to the side of the bucket in the Saulter invention, however, M. M. Kislev uses chains for side cutters, not a ram.

SUMMARY

This device excavates soil from beneath buried utility pipe. The excavated soil is pushed out using a piston shaft actuated ram having a head. The piston shaft is attached to a bucket of a power shovel. The piston shaft is hydraulically operated. Soil from the excavated area, when pushed out, falls into a previously dug opposite trench that is deeper than the bucket side trench where the shovel bucket is positioned for the pushing operation. Once the soil is pushed out from beneath buried pipe, the pipe is now accessible for inspections.

Advantages

The advantage of this present invention is increased safety of workers. Laborers, who, before this device was invented, crawled into the trench and cleaned out beneath the buried pipe using manual labor, are no longer exposed to safety concerns in the trench. Removing the laborers from the trench has the cascading effect of eliminating the need for safety procedures for that aspect of the excavating job. Also, the cost of excavating and the time to prepare for inspections follow this same principle of economy. Cost and time are both reduced.

BRIEF DESCRIPTION OF THE DRAWINGS

The objects of this invention and other features, aspects, and advantages will become apparent to those skilled in the art with regard to the following description, appended claims, and accompanying drawings.

DRAWINGS---Reference Numerals

Figure 1:
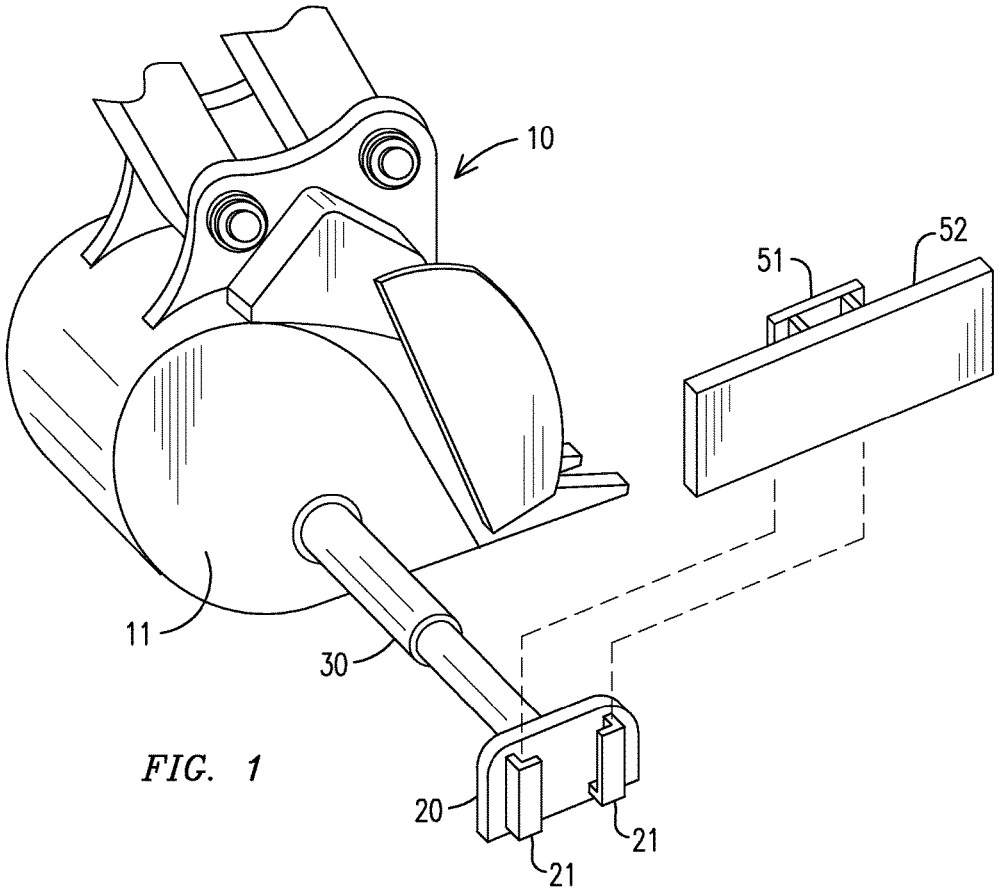
FIG. 1 is a perspective drawing of a ram having a head extended from the side wall of a bucket attached to a power shovel.

| | | | |
|---|---|---|---|
| 10 | Power shovel bucket | 11 | Bucket side wall |
| 15 | Width dimension of the bucket | 20 | Head |
| 21 | head attachment brackets | 30 | Piston shaft |
| 31 | Hydraulic press | 35 | Pinned coupling |
| 40 | Buried Pipe | 45 | Pin |
| 50 | Soil beneath buried pipe | 51 | Tongued coupling |
| 52 | Alternate head device | 60 | Fill side trench floor |
| 65 | Bucket side trench floor | 70 | Extended piston shaft |
| 71 | Retracted piston shaft | 80 | Power shovel |
| 90 | Fill soil | | |

DETAILED DESCRIPTION

For illustrative purposes only, the following are various embodiments of the ram that pushes soil from beneath buried pipe. The invention is an excavating device consisting of a power shovel bucket 10 where within is fitted a hydraulic press 31 and a piston shaft 30. A head 20 is coupled to a piston shaft 30. The piston shaft 30 telescopes to extend to a range larger than the outside diameter of the buried pipe 40. The piston shaft 30 is mounted and installed inside the power shovel bucket 10. The head 20 pushes soil beneath buried pipe 50 using hydraulic force on the piston shaft 30. The invention is a ram that pushes soil from beneath buried pipe to permit access for inspection of underground utility piping. The head 20 is a metal plate. The shape of the head 20 is rectangular, but other shapes will suffice to perform a pushing function also. A head 20 uses a pinned coupling 35 to attach the head 20 to the piston shaft 30. The head 20 rests, in the retracted position, outside of the bucket side wall 11. The head 20 is a shaped metal plate of mass and structure to push soil beneath buried pipe 50. Head attachment brackets 21, and an alternate head device 52 are used for moving larger quantities of soil beneath buried pipe 50 in one stroke of the piston. The power shovel bucket 10 is positioned in the bucket side trench floor 65 and pushes soil beneath buried pipe 50 causing the fill soil 90 to be displaced into the fill side trench floor 60. The fill side trench floor 60 is dug slightly deeper by the power shovel operator prior to the process of pushing the soil from beneath buried pipe 50.

The range of travel of the head 20 beneath the buried pipe 40 is a function of the travel of the piston shaft 30. Both single stage and multiple-stage piston shaft(s) 30 may be utilized to push soil. The determination of the range of travel of the head 20 is further a function of the width dimension of the bucket 15. When the head 20 is in the retracted piston shaft 71 position, the piston shaft 30 is fitted inside the power shovel bucket 10. Only the head 20 and a portion of the pinned coupling 35 remain outside the power shovel bucket side wall 11 when the piston shaft 30 is retracted. Retraction of the piston shaft 30 serves not only to permit repetitious excavating capability of the invention, but also allows for unobstructed travel of the power shovel bucket 10 to and from various work sites.

The piston shaft 30 is an arm member that is slideably telescopic using concentric shafts. The piston shaft 30 is a combination of one shaft within an outer shaft.

Figure 2:
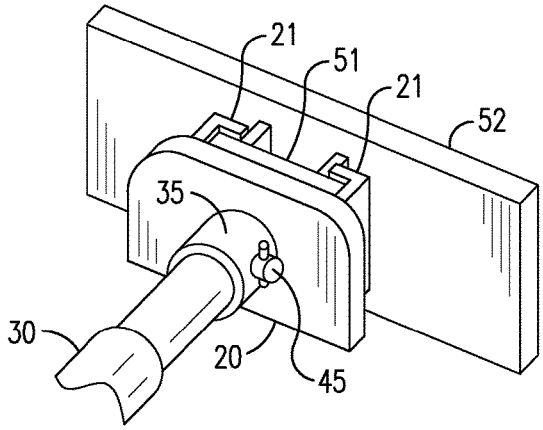
FIG. 2 is a perspective drawing of the ram having a head, a piston shaft to head connection, attachment brackets for larger alternate head devices.

FIG. 2 shows the pin 45 and the pinned coupling 35 detail of the piston shaft 30 to the head 20. FIG. 2 also shows an attachment scheme for holding an alternate device 52. Head attachment brackets 21 are angle iron pieces fabricated to fit on the face of a ram's head 20. The head attachment brackets 21 are welded at a distance apart to form the groove to accept a tongued coupling 51. The head attachment brackets 21 include a metal bottom welded to the head 20 to support the weight to the tongued coupling 51 and the alternate head device 52.

Figure 4:
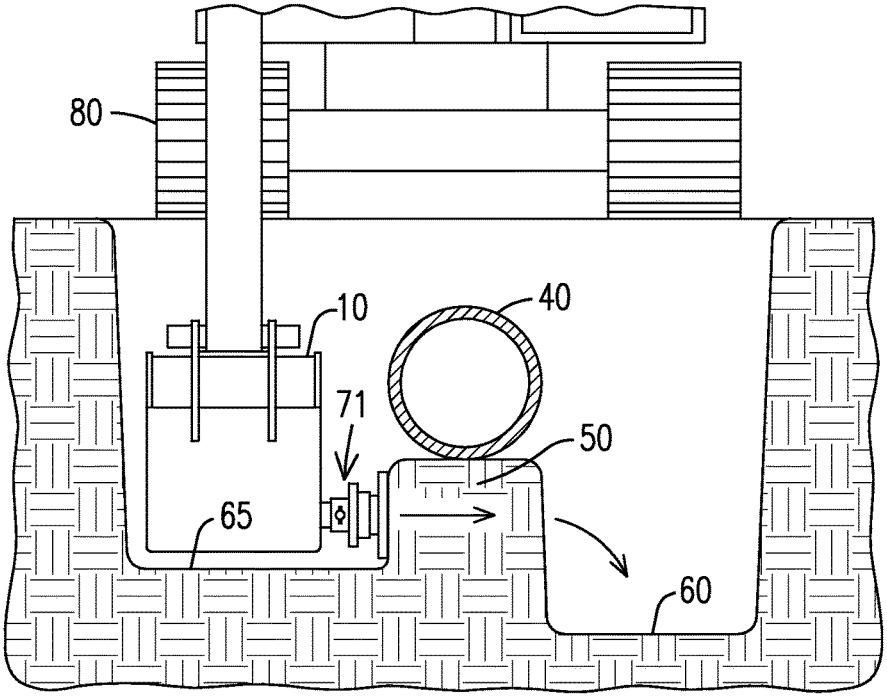
FIG. 4 is used to demonstrate the power shovel positioned in the bucket side trench with the ram having a head retracted and ready to push soil from beneath a utility pipe. A person skilled in the art will note a deeper trench on the opposite side from where the shovel is positioned. This opposite, deeper, fill side trench floor accepts excavated fill soil, leaving a reasonably level trench upon completion of the excavating process.

The arrangement of the head 20, the pin 45, the pinned coupling 35, the piston shaft 30, the hydraulic press 31, and the power shovel bucket 10 are illustrated in FIG. 4. The width dimension of the bucket 15 establishes the size of the hydraulic press 31 to utilize. The size of the hydraulic press 31, and its multi-stage capability, determine the range of stroke of the piston shaft 30. The range of stroke of the piston shaft 30 determines how far the head 20 will protrude from the bucket side wall 11. Larger power shovel buckets 10 are used for larger diameter buried pipe 40. Smaller power shovel buckets 10 correlate with smaller diameter buried pipe 40.

FIG. 4 illustrates a power shovel 80 positioned to set the power shovel bucket 10 into a position to use the head 20. A method used by the operator, while using this invention, is to dig the opposite fill side trench floor 60 at a depth slightly deeper that the bucket side trench floor 65.

Figure 3:
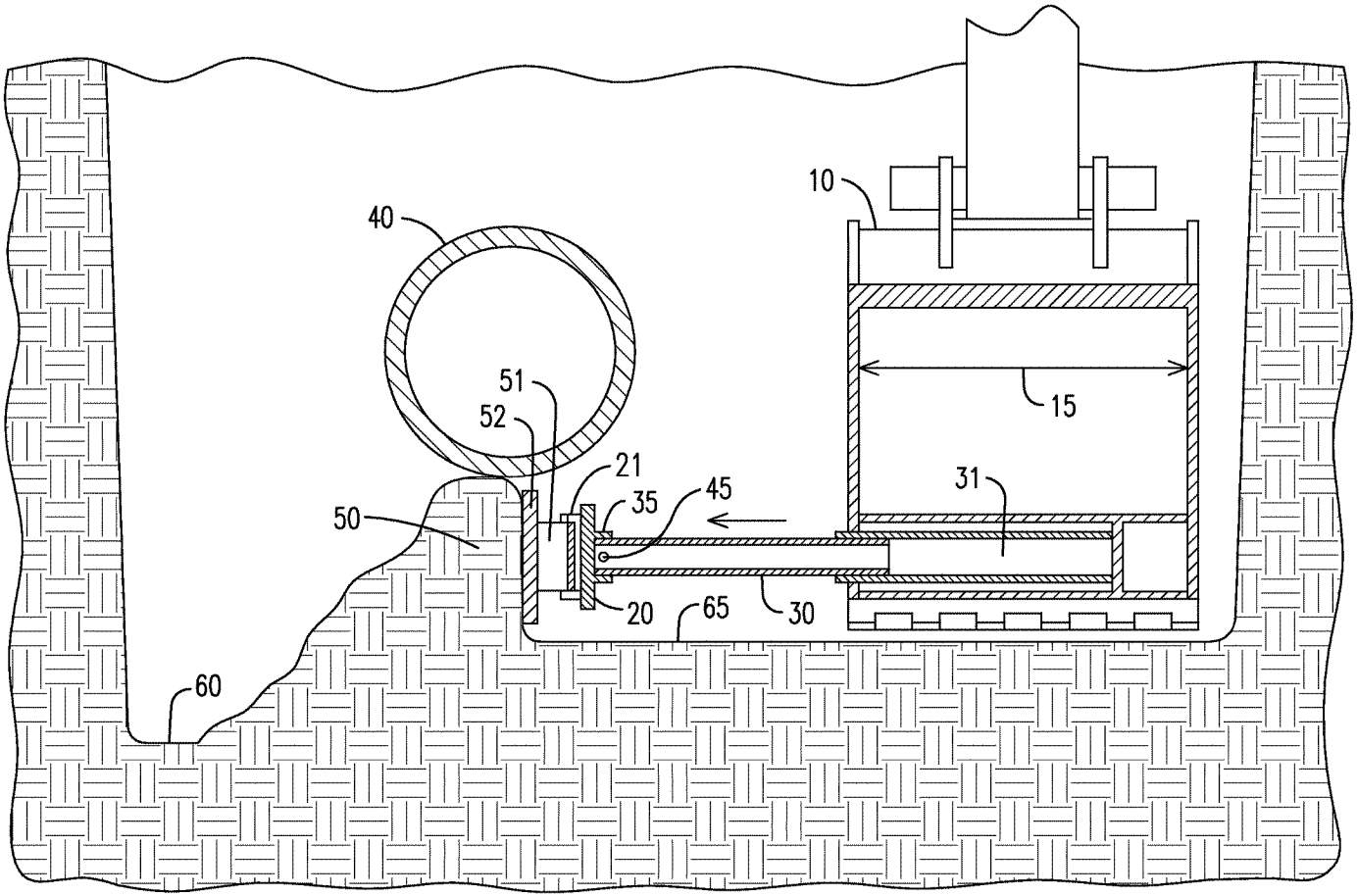
FIG. 3 shows the ram that pushes soil from beneath buried pipe in operation.
Figure 5:
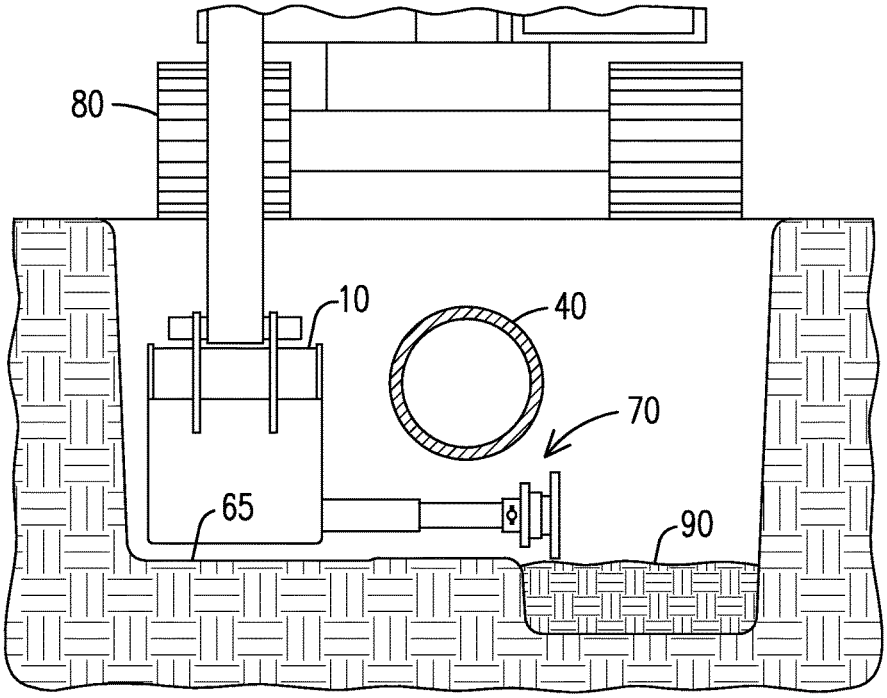
FIG. 5 shows the ram having a head at a full stroke of the piston shaft. The drawing also shows the excavated soil resting in the opposite fill side trench. Filling in the slightly deeper fill side trench establishes a usably level work platform for inspectors.

When the head 20 pushes soil beneath buried pipe 50 as illustrated in FIG. 3, that excavated soil, now fill soil 90, fills the opposite fill side trench floor 60 that was originally dug slightly deeper. FIG. 5 shows the extended piston shaft 70. The end result is a trench with a level surface useable for the next set of workers; generally the inspectors of the pipe. Manual labor accomplished this excavating work in the past under stringent guidelines of OSHA.

CONCLUSION, RAMIFICATIONS AND SCOPE

Although the present invention has been described in considerable detail with reference to certain preferred versions thereof, other versions are possible. Therefore, the spirit and scope of the appended claims should not be limited to the description of the preferred version contained therein.

The reader's attention is directed to all papers and documents which are filed concurrently with this specification and are open to public inspection with this specification, and the contents of all such papers and documents are incorporated herein by reference. All features disclosed in this specification (including any accompanying claims, abstract, and drawings) may be replaced by alternative features serving the same, equivalent or similar purpose, unless expressly stated otherwise. Each feature disclosed is one example only of a generic series of equivalent or similar features.

While the above description contains much specificity, these should not be construed as limitations on the scope of any embodiment but as exemplifications of the presently preferred embodiments thereof. Other ramifications and variations are possible within the teachings of the various embodiments. Thus, the scope of the invention should be determined by the appended claims and their legal equivalents, not by the examples given.

SEQUENCE LISTING

Not Applicable

What I claim is:

1. An excavating device comprising a head, said head coupled with a pin to a piston shaft, said piston shaft, protruding out through a bucket side wall, connected to a hydraulic press, said hydraulic press mounted horizontally within a bucket of a power shovel, said hydraulic press operated to push dirt from beneath a pipe to permit access for inspection of underground utility piping.

2. The device of claim 1 whereby said head is a rectangular shaped metal plate, and when said head is in a retracted position as established by operation of said hydraulic press, then said head rests near an outside face of said bucket side wall, and when said piston shaft is extending by operation of said hydraulic press, said head pushes soil from beneath buried pipe utilizing compressive force of said hydraulic press transmitted through said piston shaft that is coupled to said head.

3. The device of claim 1 whereby ram attachment brackets are fitted to said head of said ram by welding angle brackets to a surface of said head, and thereby forming a receptacle to accept a tongued coupling of a head device of a larger size to permit attachment to move larger quantities of soil beneath buried pipe in one extending stroke of said piston shaft.

4. The device of claim 1 whereby said head is coupled to said piston shaft with said pin utilizing a sleeve coupling device fitted onto an end of said piston shaft opposite of the end connected to said hydraulic press, and whereby said coupling device is held secure on said piston shaft utilizing said pin passing through said coupling device and also through said piston shaft to enable attachment of said head to said piston shaft.

5. The device of claim 1 whereby said piston shaft is a set of telescoping concentric shafts connected at one end to said hydraulic press and at an opposite end to said coupling device whereby said piston shaft passes through said bucket side wall of said power shovel and whereby said piston shaft is extended utilizing hydraulic forces generated by said hydraulic press to push said head and whereby said piston shaft is retracted utilizing hydraulic forces in an opposite direction from extension to withdraw said head.

6. The device of claim 1 whereby said hydraulic press is horizontally mounted within said bucket side walls of said power shovel such that said piston shaft protrudes out through a side wall of said bucket when an extending force is generated by said hydraulic press.

* * * * *